United States Patent [19]

Koppelman

[11] Patent Number: 4,626,258

[45] Date of Patent: Dec. 2, 1986

[54] MULTIPLE HEARTH APPARATUS AND PROCESS FOR THERMAL TREATMENT OF CARBONACEOUS MATERIALS

[76] Inventor: Edward Koppelman, 4424 Bergamo Dr., Encino, Calif. 91316

[21] Appl. No.: 683,591

[22] Filed: Dec. 19, 1984

[51] Int. Cl.[4] ..... C10L 9/08; F26B 5/04; F26B 17/12

[52] U.S. Cl. ..... 44/2; 44/29; 44/33; 422/142; 422/146

[58] Field of Search ..... 44/2, 29, 33, 12, 1 R.; 422/142, 146, 193, 216, 232

[56] References Cited

U.S. PATENT DOCUMENTS

| | | | |
|---|---|---|---|
| 3,968,756 | 7/1976 | Yamada | 110/12 |
| 4,046,086 | 9/1977 | Von Dreusche | 110/12 |
| 4,052,168 | 10/1977 | Koppelman | 44/1 G |
| 4,182,246 | 1/1980 | Lombana et al. | 110/188 |
| 4,248,164 | 2/1981 | Isheim | 110/225 |
| 4,254,643 | 5/1979 | Cook | 422/185 X |
| 4,261,268 | 4/1981 | Von Dreusche, Jr. et al. | 110/216 |
| 4,347,156 | 8/1982 | Lombana et al. | 110/225 X |
| 4,371,375 | 2/1983 | Dennis, Jr. et al. | 44/2 |
| 4,391,208 | 7/1983 | Lewis | 110/346 |
| 4,398,476 | 8/1983 | Suzuki | 110/188 |
| 4,453,474 | 6/1984 | Lewis | 110/188 |

*Primary Examiner*—Carl F. Dees
*Attorney, Agent, or Firm*—Harness, Dickey & Pierce

[57] ABSTRACT

A multiple hearth reactor apparatus and process for the thermal treatment of organic carbonaceous materials under controlled pressure and temperature comprising in accordance with one embodiment, a pressure vessel containing a plurality of superimposed annular hearths including a series of upper hearths defining a preheating zone and a series of lower hearths spaced therebelow defining a reaction zone. The reactor is provided with an inlet for introducing a moist carbonaceous feed material under pressure into the preheat zone and the feed material is transferred downwardly in a cascading manner through the preheat zone and reaction zone. The solid product is extracted from the lower portion of the apparatus while waste water and product gas are extracted from the preheat zone. The hot gases are passed in countercurrent fashion to effect a preheating of the feed material. In accordance with a second embodiment of the apparatus, a separate chamber is employed for preheating of the feed material and the preheated and partially dewatered feed material is thereafter directly charged into the multiple hearth apparatus defining the reaction zone. In operation, the apparatus is adapted to operate at temperatures ranging from about 200° F. up to about 1200° F. or higher at pressures generally ranging from about 300 up to about 3000 psig. Residence times of as little as 1 minute up to about 1 hour or longer can be employed depending upon the nature of the feed material and the desired thermal restructuring.

14 Claims, 5 Drawing Figures

MULTIPLE HEARTH APPARATUS AND PROCESS FOR THERMAL TREATMENT OF CARBONACEOUS MATERIALS

BACKGROUND OF THE INVENTION

The multiple hearth apparatus and process of the present invention is broadly applicable for the processing of organic carbonaceous materials containing residual moisture under controlled pressure and elevated temperatures to effect a desired physical and/or chemical modification thereof to produce a thermally restructured reaction product suitable for use as a fuel. More particularly, the present invention is directed to a reactor and process by which carbonaceous materials containing appreciable quantities of moisture in the raw feed state are subjected to elevated temperature and pressure conditions whereby a substantial reduction in the residual moisture content of the solid reaction product is effected in addition to a desired thermal chemical restructuring of the organic material to impart improved physical properties thereto including an increased heating value on a dry moisture-free basis.

Shortages and increasing costs of conventional energy sources including petroleum and natural gas have occasioned investigations of alternative energy sources which are in plentiful supply such as lignitic-type coals, sub-bituminou coals, cellulosic material such as peat, waste cullolosic materials such as sawdust, bark, wood scrap, branches and chips derived from lumbering and sawmill operations, various agricultural waste materials such as cotton plant stalks, nut shells, corn husks or the like and municipal solid waste pulp. Such alternative materials, unfortunately, in their naturally occurring state are deficient for a number of reasons for use directly as high energy fuels. Because of this, a variety of processes have heretofore been proposed for converting such materials into a form more suitable for use as a fuel by increasing their heating value on a moisture-free basis while at the same time increasing their stability to weathering, shipment and storage.

Typical of such prior art apparatuses and processes are those as described in U.S. Pat. No. 4,052,168 by which lignitic-type coals are chemically restructured by a controlled thermal treatment providing an upgraded solid carbonaceous product which is stable and resistant to weathering as well as being of increased heating value approaching that of bituminous coal; U.S. Pat. No. 4,127,391 in which waste bituminous fines derived from conventional coal washing and cleaning operations is thermally treated to provide solid agglomerated coke-like products suitable for direct use as a solid fuel; and U.S. Pat. No. 4,129,420 in which naturally occurring cellulosic materials such as peat as well as waste cellulosic materials are upgraded by a controlled thermal restructuring process to provide solid carbonaceous or coke-like products suitable for use as a solid fuel or in admixture with other conventional fuels such as fuel oil slurries. A reactor and process for effecting an upgrading of such carbonaceous feed materials of the types described in the aforementioned United States patents is disclosed in U.S. Pat. No. 4,126,519 by which a liquid slurry of the feed material is introduced into an inclined reactor and is progressively heated to form a substantially dry solid reaction product of enhanced heating value. The reaction is performed under a controlled elevated pressure and temperature in further consideration of the residence time to attain the desired thermal treatment which may include the vaporization of substantially all of the moisture in the feed material as well as at least a portion of the volatile organic constituents while simultaneously undergoing a controlled partial chemical restructuring or pyrolysis thereof. The reaction is carried out in a nonoxidizing environment and the solid reaction product is subsequently cooled to a temperature at which it can be discharged in contact with the atmosphere without combustion or degradation.

While the processes and apparatuses as described in the aforementioned United States patents have been found to provide satisfactory treatment of a variety of raw carbonaceous feed materials to produce an upgraded solid reaction product, there is a continuing need for a reactor and process which provides for still further efficiency, versatility, simplicity and ease of control in the continuous thermal treatment of a variety of such moist raw carbonaceous feed materials providing thereby still further economies in the conversion and production of high-energy solid fuels as a replacement and alternative to conventional energy sources.

SUMMARY OF THE INVENTION

The benefits and advantages of the present invention in accordance with one of the apparatus embodiments thereof are achieved by a multiple hearth reactor apparatus comprising a pressure vessel defining a chamber containing a plurality of superimposed annular hearths including a series of upper hearths which are angularly inclined downwardly toward the periphery of the chamber defining a drying or preheating zone in which moisture and chemically combined water in the feed material is extracted. Disposed below the upper hearths, is a series of lower hearths defining a reaction zone including heating means for effecting a heating of the feed material to an elevated temperature under a controlled super atmospheric pressure for a period of time sufficient to vaporize at least a portion of the volatile substances therein and to form volatile reaction gases and a solid reaction product of enhanced heating value on a moisture-free basis. The hot reaction gases formed in the reaction zone pass upwardly in heat exchange relationship with the feed material in the drying zone in a countercurrent manner effecting at least a partial condensation of the condensible portions thereof on the incoming feed material effecting a preheating thereof by a liberation of the latent heat of vaporization and further effecting a liberation of chemically combined water in the feed material which is extracted from the angularly inclined hearths under pressure to a position exterior of the reactor.

The reaction vessel is provided with a centrally extending rotatable shaft having a plurality of rabble arms thereon disposed adjacent to the upper surface of each of the hearths and are operative upon rotation thereof to effect a progressive transfer of the feed material radially along each hearth in an alternating inward and outward direction to effect a downward cascading travel of the feed material from one hearth to the next hearth therebelow. Annular baffles are preferably employed in the drying zone of the reactor disposed above the hearths and rabble arms thereabove to confine the flow of countercurrent hot reaction gases in a region immediately adjacent to the feed material on such hearths in order to enhance contact and heat transfer between the feed material and gases.

The solid thermally restructured reaction product is extracted from the bottom portion of the reactor and is transferred to a suitable cooling chamber in which it is cooled to a temperature at which it can be discharged in contact with the atmosphere without adverse effects.

The reactor is provided with an outlet in the upper portion thereof for withdrawing the reaction gases under pressure as a product gas which can be employed, if desired, for combustion and heating of the reaction zone of the reactor. The upper portion of the reactor is also provided with an inlet by which the raw carbonaceous feed material or mixtures thereof are introduced through a suitable pressure lock into the reaction chamber and on to the uppermost hearth in the drying zone.

In accordance with an alternative satisfactory embodiment of the apparatus of the present invention, a drying and preheating of the feed material is effected in a first stage reactor disposed exteriorly of the multiple hearth reactor and the resultant preheated and partially dewatered feed material is thereafter discharged into the multiple hearth reactor defining the reaction zone similar to the reaction zone comprising the lower portion of the composite multiple hearth reactor as hereinbefore described. It is further contemplated in accordance with both apparatus embodiments that suitable cleaning devices such as wire brushes can be employed for removing any accumulation of encrustations from the exterior surfaces of the annular baffles to maintain optimum operating efficiency of the apparatus. It is further contemplated that the tubular heat exchange elements or electrical heating elements can be enclosed within conductive shields and which similarly are subjected to cleaning to maintain optimum heat transfer characteristics.

In accordance with the process aspects of the present invention, the moist organic carbonaceous feed materials are introduced into a preheating zone separate from or integrally combined with the reactor in which the feed material is preheated by the countercurrent flow of reaction gases to a temperature of from about 300° to about 500° F. Simultaneously, moisture condensing on the cool incoming feed material as well as moisture liberated in response to the heating thereof is drained from the feed material and is extracted from the preheating zone under pressure through a drain system. The feed material in a partially dewatered state passes from the preheating zone downwardly through the reaction zone and is heated to a temperature of from about 400° to about 1200° F. or higher under a pressure ranging from about 300 to about 3000 psi or higher for a period of time generally ranging from as little as about 1 minute up to about 1 hour or longer to effect a vaporization of at least a portion of the volatile substances therein forming a gaseous phase and a solid reaction product.

Additional benefits and advantages of the present invention will become apparent upon a reading of the Description of the Preferred Embodiments taken in conjunction with the drawings and the specific examples provided.

DESCRIPTION OF THE PREFERRED EMBODIMENTS

Figure 1:
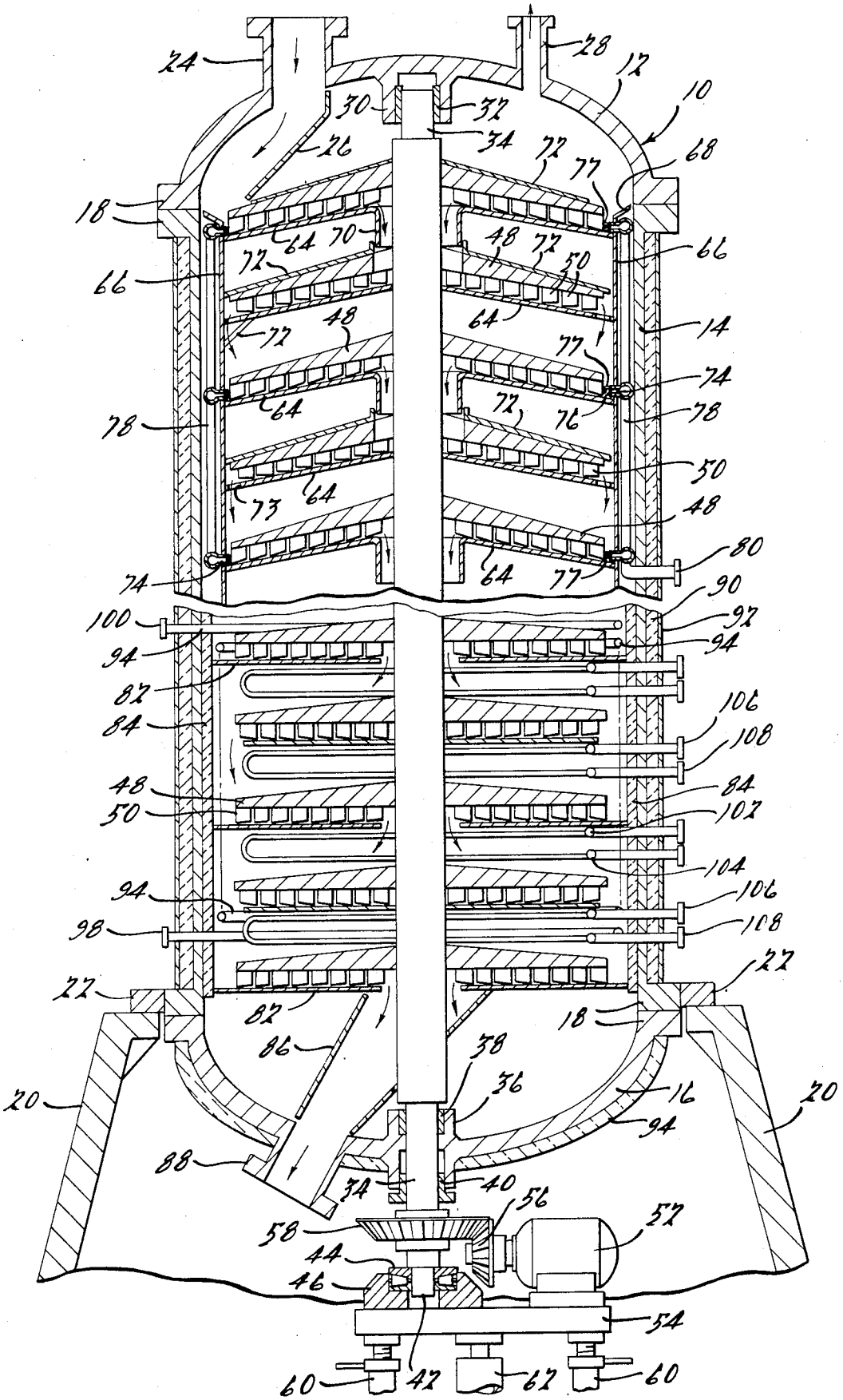
FIG. 1 is a vertical transverse sectional view through a multiple hearth reactor apparatus constructed in accordance with the preferred embodiments of the present invention.
Figure 2:
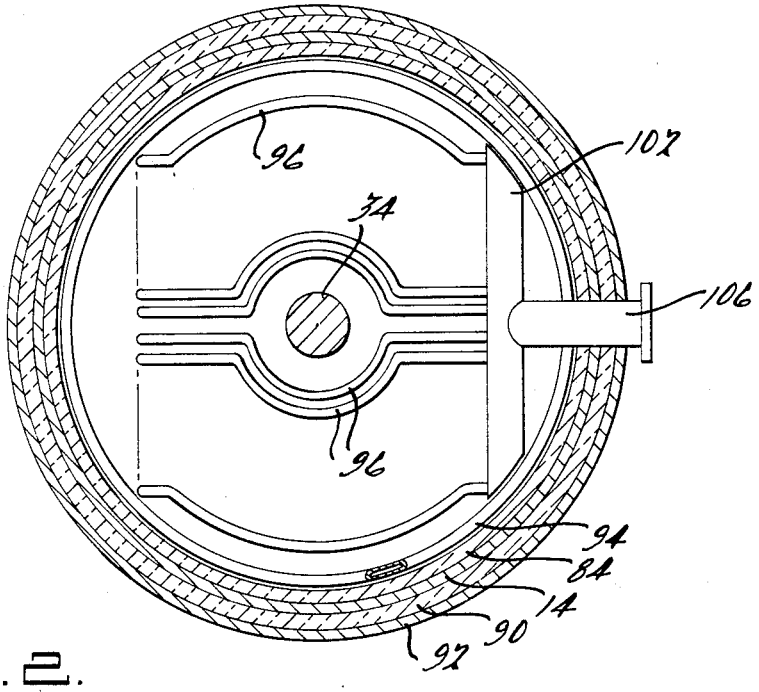
FIG. 2 is a transverse horizontal sectional view through the apparatus shown in FIG. 1 and taken through the reactor section illustrating the disposition of the transverse heat exchanger tubes.
Figure 3:
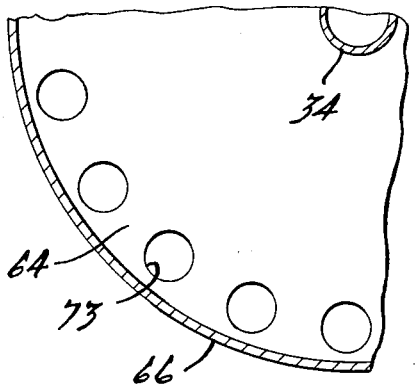
FIG. 3 is a fragmentary view partially in section of the discharge ports in an inclined annular hearth positioned within the upper preheating zone of the reactor apparatus shown in FIG. 1.

Referring now in detail to the drawings, and as may be best seen in FIGS. 1 through 3, a multiple hearth reactor apparatus in accordance with one of the embodiments of the present invention comprises a pressure vessel 10 comprising a dome-shaped upper portion 12, a circular cylindrical center section 14 and a dome-shaped lower portion 16 secured together in gas-tight relationship by means of annular flanges 18. The reactor is supported in a substantially upright position by means of a series of legs 20 secured to abutments 22 connected to the lower flange 18 of the center section of the vessel. The upper domed portion 12 is provided with a flanged inlet 24 for introducing a particulated moist carbonaceous feed material into the interior of the reactor. An angular baffle 26 is provided adjacent to the inlet 24 for directionally guiding the entering feed material toward the periphery of the reaction chamber. A flanged outlet 28 is provided at the opposite side of the upper portion 12 for withdrawing volatile reaction gases under pressure from the reaction chamber in a manner subsequently to be described in further detail. A downwardly depending annular boss 30 is formed on the inner central portion of the upper portion 12 in which a bearing 32 is disposed for rotatably supporting the upper end of a rotary shaft 34.

The rotary shaft 34 extends centrally of the interior of the reactor and is rotatably journaled at its lower end in an annular boss 36 formed in the lower portion 16 by means of a bearing 38 and a fluid-tight seal assembly 40. The outward projecting end of the rotary shaft 34 is formed with a stepped stub shaft portion 42 which is seated in supported relationship within a thrust bearing 44 mounted in a bearing carrier 46.

A plurality of radially extending rabble arms 48 are affixed to and project radially from the rotary shaft 34 at vertically spaced intervals therealong. Generaly, two, three or four rabble arms can be employed in the preheating or drying zone and up to six rabble arms can be employed in the reaction zone. Typically, four rabble arms disposed at approximately 90 degree increments are affixed at each level to the rotary shaft. A plurality of angularly disposed rabble teeth 50 are affixed to the lower sides of the rabble arms 48 and are angularly oriented so as to effect a radial inward and outward transfer of feed material along the multiple hearths in response to rotation of the shaft.

Rotation of the shaft 34 and the rabble arm assemblies thereon is achieved by means of a motor 52 supported on an adjustable base 54 having a bevel drive gear 56 affixed to the output shaft thereof which is disposed in constant meshing relationship with a driven bevel gear 58 affixed to the lower end portion of the shaft. The motor 52 is preferably of the variable speed type to provide controlled variations in the speed of rotation of the shaft.

In order to provide for longitudinal expansion and contraction of the shaft and variations in the vertical disposition of the rabble arms projecting thereform in response to variations in the temperature within the multiple hearth reactor, the base 54 and the outward projecting end of the shaft 34 are disposed on adjustable jacks 60 assisted by a fluid actuated cylinder 62 for selectively varying the height of the base 54 to assure appropriate disposition of the rabble teeth 50 relative to the upper surfaces of the hearths within the reactor.

In accordance with the specific arrangement shown in FIG. 1, the interior of the reactor is divided into an upper preheat or dewatering zone and a lower reaction zone. The preheating zone is comprised of a plurality of superimposed angularly inclined annular hearths 64 which slope downwardly toward the periphery of the reaction chamber. The upper preheating zone is provided with a circular cylindrical liner 66 which is radially spaced inwardly of the wall 14 of the center section and to which the angularly inclined hearths 64 are affixed. The uppermost end of the liner 66 is formed with an outwardly inclined section 68 to prevent entry of any carbonaceous feed material between the annular space between the liner and wall 14 of the center section. The uppermost hearth 64 as viewed in FIG. 1 is connected at its periphery to the liner 66 and extends upwardly and inwardly toward the rotary shaft 34. The hearth 64 terminates in a downwardly disposed circular baffle 70 which defines an annular chute through which the feed material cascades downwardly on the inner portion of the annular hearth therebelow. The downwardly inclined annular hearth 64 disposed below the uppermost hearth 64 is affixed to and supported by means of brackets 72 to the liner 66 at angularly spaced intervals therealong. The second annular hearth 64 as best seen in FIG. 3 is formed with a plurality of ports or apertures 73 around the periphery thereof through which the feed material is discharged in a cascading manner to the next hearth therebelow. In accordance with the foregoing arrangement, a moist carbonaceous feed material introduced through the inlet 24 is diverted by the baffle 26 to the outer periphery of the uppermost hearth 64 and is thereafter transferred upwardly and inwardly by means of the rabble teeth 50 to a position above the circular baffle 70 whereby it drops downwardly to the hearth spaced therebelow. Similarly, the rabble teeth 50 on the second uppermost hearth are effective to transfer the feed material downwardly and outwardly along the upper surface of the hearth for ultimate discharge through the ports 73 around the periphery thereof. The feed material continues to pass downwardly in an alternating inward and outward cascading fashion as indicated by the arrows in FIG. 1 and is ultimately discharged into the lower reaction zone.

During its downward cascading travel, the feed material is subjected to contact with the countercurrent upward flow of heated reaction gases effecting a preheating thereof to a temperature generally between about 200° to about 500° F. In order to assure intimate contact of the feed material with the upwardly traveling reaction gases, annular baffles 72 are disposed immediately above the rabble arms 48 over at least some of the angularly inclined hearths 64 to confine the flow of such hot reaction gases to a vicinity immediately adjacent to the upper surface of the annular hearths and in heat exchange relationship with the feed material thereon. A preheating of the feed material is achieved in part by the condensation of condensible portions of the reaction gas such as steam on the surfaces of the cool incoming feed material as well as by direct heat exchange. The condensed liquids as well as the liberated chemically combined water in the incoming feed material drains downwardly and outwardly along the angularly inclined hearths and is withdrawn at the periphery of those hearths connected at their outermost ends to the circular liner through an annular gutter 74 provided with a screen 76 such as a Johnson Screen over its inlet end which is adapted to be continuously wiped by a scraper element or wire brush 77 on the outermost rabble tooth on the adjacent rabble arm. The annular gutters 74 are disposed in communication with downcomers 78 disposed within the annular space between the liner 66 and wall 14 of the center section and the liquid is withdrawn from the reaction vessel through a condensate outlet 80 as shown in FIG. 1.

The cooled reaction gases passing upwardly through the preheat zone are ultimately withdrawn from the upper portion 12 of the pressure vessel through the flanged outlet 28.

The preheated and partially dewatered feed material passes from the lowermost hearth in the preheat zone to the uppermost annular hearth 82 within the reaction zone under continued controlled elevated pressure and is subjected to further heating to temperatures generally ranging from about 400° up to about 1200° F. or higher. The annular hearths 82 in the reaction zone are disposed in a substantially horizontal position and alternating ones thereof are disposed with the periphery thereof in substantial sealing relationship against a circular cylindrical refractory lining 84 on the inside wall 14 of the center section. The rabble teeth 50 on the rabble arms 48 in the reaction zone similarly effect an alternating radial inward and radial outward movement of the feed material through the reaction zone in a cascading manner as indicated by the arrows in FIG. 1. The substantially moisture free and thermally upgraded solid reaction product is discharged at the center of the lowermost hearth 82 into a conical chute 86 and is extracted from the pressure vessel through a flanged product outlet 88.

In order to further reduce loss of heat from the pressure vessel, the cylindrical section as well as the lower portion 16 is provided with an outer layer of insulation 90 of any of the types wellknown in the art. The center section is preferably further provided with an outer shell 92 to protect the insulation therebelow.

A heating of the feed material within the reaction zone can be achieved by electrical heating elements disposed therein, by a jacket encircling the periphery of the wall 14 of the center section through which a heat exchange fluid is circulated, or alternatively in accordance with the arrangement as shown in FIG. 1, by a circumferential tubular heat exchange arrangement comprising a helical tube bundle 94 disposed adjacent to the inner surface of the refractory lining 84 as well as a transverse heat exchanger comprising a plurality of U-shaped tubes 96 projecting horizontally across the pressure vessel at a position immediately below the annular hearths 82 therein. The tube bundle 94 of the circumferential heat exchanger is connected by means of a flanged inlet 98 and a flanged outlet 100 to an external supply of a heat transfer fluid such as compressed carbon dioxide or like transfer fluids. The U-shaped tubes 96 of the transverse heat exchanger as best seen in FIGS. 1 and 2 are connected to an inlet header and an outlet header 102 and 104 respectively, which are in turn connected to a flanged inlet 106 and flanged outlet 108 extending through the wall of the pressure vessel. The circumferential and transverse heat exchanger systems can be connected to the same source of heat exchange fluid or alternatively, in accordance with a preferred embodiment as further schematically illustrated in FIG. 4, are connected to separate heating sources enabling independent control of each system to achieve the desired heating and thermal restructuring of the feed material in the reaction zone.

Figure 4:
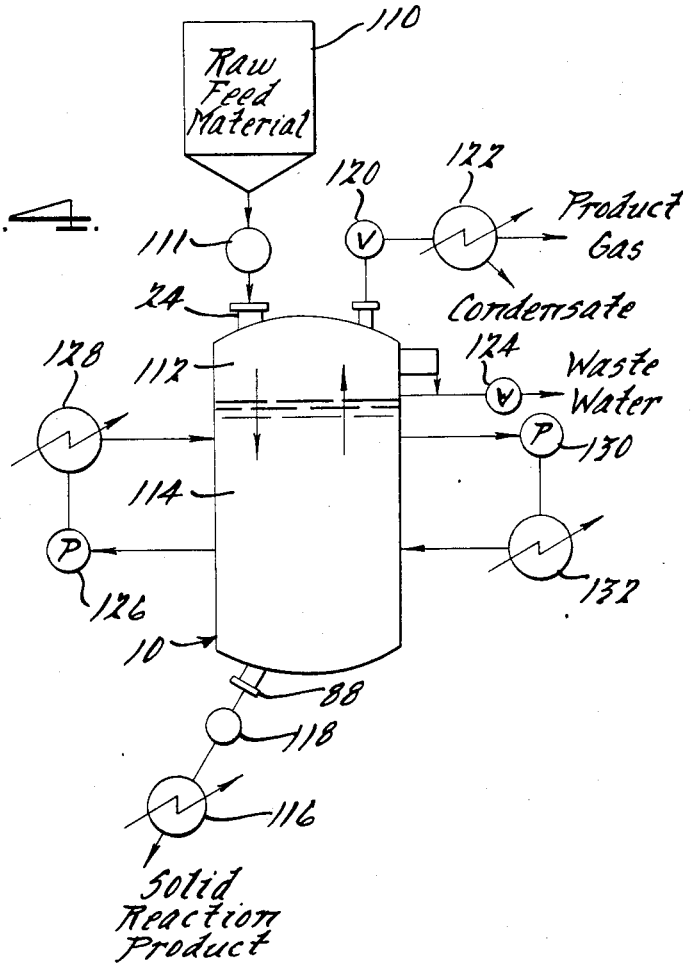
FIG. 4 is a schematic flow diagram of the reactor apparatus and the several process streams associated in the thermal treatment of carbonaceous feed materials.

In operation and with particular reference to the flow diagram comprising FIG. 4 of the drawings, a suitable moist carbonaceous feed material is introduced from a storage hopper 110 through a suitable pressure lock 111 under pressure into the inlet 24 of the pressure vessel 10. The moist raw feed material is transferred downwardly through the upper preheat zone 112 in a manner as previously described and in heat exchange contact with the upwardly moving reaction gases to effect a preheating of the feed material within a temperature generally ranging from about 200° up to about 500° F. in a manner as previously described in connection with FIG. 1. Thereafter, the preheated and partially dewatered feed material passes downwardly into the lower reaction zone 114 of the multiple hearth reactor in which it is heated to an elevated temperature generally ranging from about 400° up to about 1200° F. to effect a controlled thermal restructuring or partial pyrolysis thereof accompanied by a vaporization of substantially all of the residual moisture therein as well as organic volatile constituents and pyrolysis reaction products hereinafter collectively referred to as "volatile gases". The pressure within the reactor is generally controlled within a range of about 300 up to about 3000 psi or higher depending upon the type of feed material employed and the desired thermal restructuring thereof desired to produce the desired final solid reaction product. The number of annular hearths in the preheat zone and in the reaction zone of the reactor is controlled depending upon the duration of treatment desired so as to provide a residence time of the material in the reaction zone which generally ranges from as little as about 1 minute up to about 1 hour or longer. The resultant thermally upgraded solid reaction product is discharged from the product outlet 88 in the lower section of the reactor and is further cooled in a cooled 116 to a temperature at which the solid reaction product can be discharged into contact with the atmosphere without combustion or adverse effects. Generally, a cooling of the solid reaction product to a temperature less than about 500° F., and more usually temperatures below about 300° F. is adequate. The discharge conduit from the product outlet 88 is also provided with a pressure lock 118 through which the reaction product passes to prevent loss of pressure from the reactor.

The cooled volatile reaction gases are withdrawn from the upper end of the reactor through the flanged outlet 28 and pass through a pressure letdown valve 120 to a condenser 122. In the condenser 122, the organic and condensible portions of the volatile reaction gas are condensed and extracted as by-product condensate. The noncondensible portion of the gas comprising product gas is withdrawn and can be recovered and used to supplement the heating requirements of the reactor. Similarly, the liquid portion extracted from the reactor in the preheating zone is withdrawn through a suitable pressure letdown valve 124 and is extracted as waste water. The waste water frequently contains valuable dissolved organic constituents and can be further processed to effect an extraction thereof or in the alternative, the waste water including the dissolved organic constitutents can be directly employed for forming an aqueous slurry containing portions of the comminuted solid reaction product therein to facilitate a transportation thereof to a point remote from the reactor.

Additionally, the flow diagram of FIG. 4 schematically depicts auxiliary heating systems for recirculating the fluid heat transfer medium through the circumferential and transverse heat exchanger sections of the reaction zone 114. As shown, the circumferential heat exchange system includes a pump 126 for circulating the heat transfer fluid through a heat exchanger or furnace 128 to effect a reheating thereof and for discharge into the tube bundle in the reaction zone. Similarly, the transverse heat exchanger system is provided with a recirculating pump 130 and furnace 132 for circulating and reheating the heat transfer fluid for discharge into the U-shaped tubes in reaction zone 114.

The multiple hearth reactor apparatus and process as hereinbefore shown and described in eminently adapted for processing carbonaceous materials or mixtures of such materials of the general types hereinbefore described which are generally characterized by having relatively high moisture contents in their raw feed state. The term "carbonaceous" as employed in this specification is defined as materials which are rich in carbon and may comprise naturally occurring deposits as well as waste materials generated in agricultural and forestry operations. Typically, such materials include sub-bituminous coals, lignitic-type coals, peat, waste cellulosic materials such as sawdust, bark, wood scrap, branches and chips from lumbering and sawmill operations, agricultural waste materials such as cotton plant stalks, nut shells, corn husks, rice hulls, or the like, and municipal solid waste pulp from which metallic contaminants have been removed containing less than about 50 percent by weight moisture, and typically, about 25 percent by weight moisture. The multiple hearth reactor and process as herein described is eminently suitable for processing and upgrading such cellulosic materials under the conditions and processing parameters as described in U.S. Pat. Nos. 4,052,168; 4,126,519; 4,129,420; 4,127,391; and 4,477,257, the teachings of which are incorporated herein by reference.

A typical example of the operation of the multiple hearth reactor in accordance with the embodiment of FIG. 1 for upgrading a sub-bituminous coal containing approximately 30 percent by weight moisture in the raw feed state will now be described. The raw feed coal is introduced from the feed hopper 110 as illustrated in FIG. 4 through the pressure lock 111 at a temperature of about 60° F. and at atmospheric pressure into the reactor which is maintained at a pressure of about 830 psig. The feed coal is heated in the preheat zone 112 of the reactor from about 60° F. during the course of its downward travel therethrough and enters the reaction zone 114 at a temperature of about 500° F. The waste water extracted from the preheat zone is removed at a temperature of about 323° F. at a pressure of 830 psig while product gas is also removed from the upper portion of the preheat zone at a temperature of about 323° F. at a pressure of 830 psig. The reaction gas from the reaction zone enters the lower portion of the preheat zone at a temperature of about 500° F. and at a pressure of 830 psig. The resultant solid reaction product is extracted from the bottom of the reaction zone at a temperature of about 718° F. at a pressure of 830 psig whereafter it is subsequently cooled to a temperature of about 200° F. and is discharged at atmospheric pressure.

A typical mass flow rate of the feed material and various product streams in terms of pounds per hour comprises 51,470 pounds per hour of feed material containing 15,956 pounds per hour water. The waste water recovered is 20,326 pounds per hour while the product gas comprises 5,548 pounds per hour in addition to 328 pounds per hour of steam. The solid reaction product discharged from the reactor comprises 25,368 pounds per hour and the net product gas after extraction of the condensible portions comprises 5,548 pounds per hour in addition to 328 pounds per hour water.

A heat balance of the foregoing process comprises the raw moist coal feed containing 745,085 Btu/hour charged to the reactor with the solid reaction product cooled to 200° F. containing 1,278,547 Btu/hour. The product gas recovered has a sensible heating value of 1,071,872 Btu/hour while the hot waste water extracted contains 5,955,518 Btu/hour.

The foregoing process sequence and conditions is typical for processing sub-bituminous coals and it will be understood that the particular temperatures in the various zones of the reactor, the pressure employed and the residence time of the feed material within the several zones can be varied to achieve the requisite thermal upgrading and/or chemical restructuring of the cellulosic feed material depending upon its initial moisture content, the general chemical construction and carbon content thereof, as well as the desired characteristics of the solid reaction product recovered. Accordingly, the preheat zone of the reactor can be controlled so as to effect a preheating of the incoming feed material at room temperature to an elevated temperature generally ranging from about 200° F. up to about 500° F. whereafter upon entering the reaction zone is further heated to a temperature up to about 1200° F. or higher. The pressure within the reactor can also be varied within a range of about 300 to about 3000 psig with pressures of from about 600 to about 1500 psig being typical.

Figure 5:
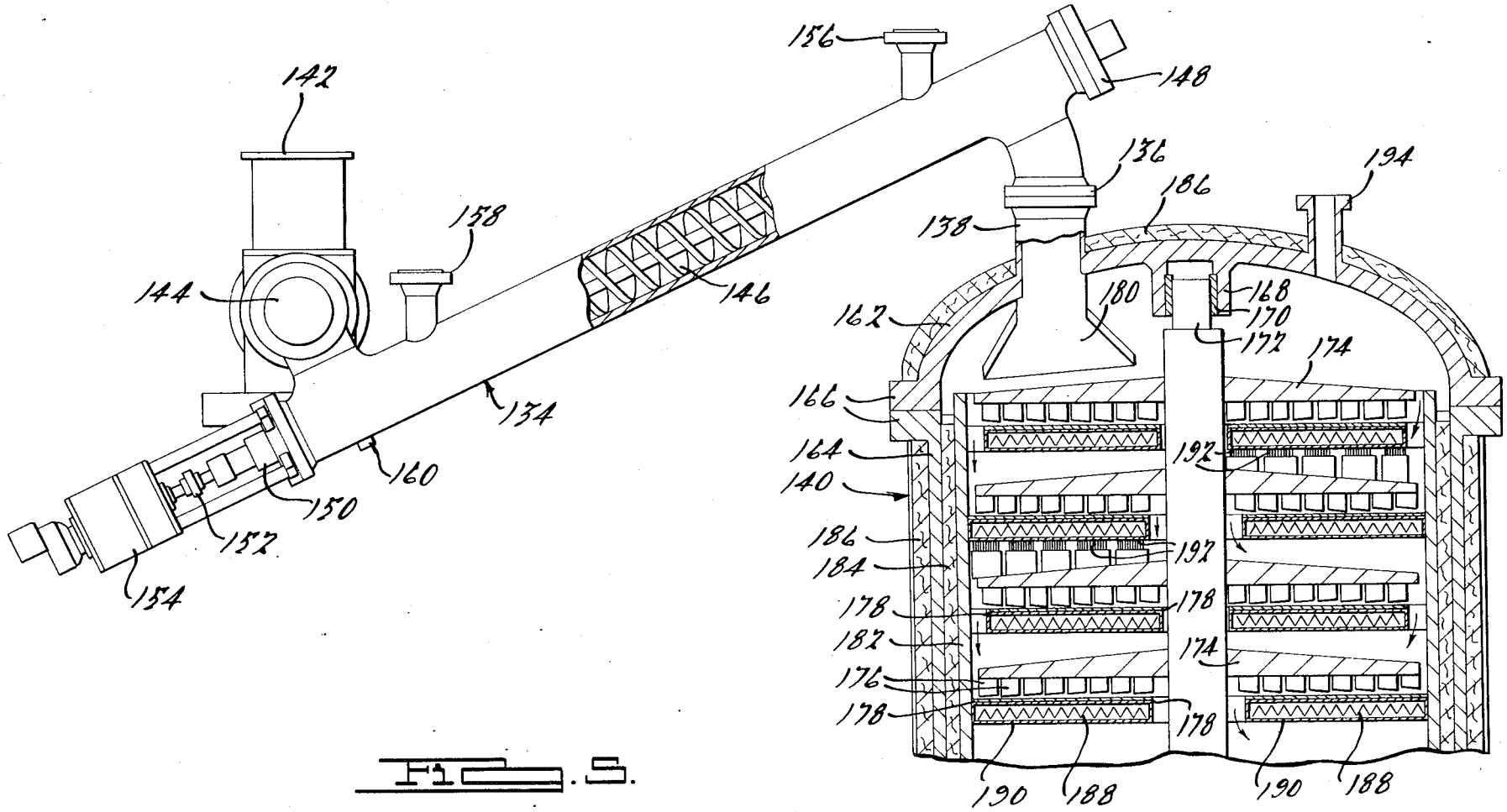
FIG. 5 is a fragmentary side elevational view partly in section of a multiple hearth reactor apparatus provided with a separate preheating and drying stage separate from the reactor in accordance with an alternative embodiment of the present invention.

In accordance with an alternative satisfactory embodiment of the apparatus comprising the present invention, as best seen in FIG. 5, an alternative arrangement is illustraetd in which the preheat zone is defined by an inclined chamber 134 which is disposed with the upper outlet end thereof connected via a flange 136 to a flanged inlet 138 of a multiple hearth reactor 140 defining the reaction zone. The chamber 134 is provided at its lower end portion with an inlet 142 through which the moist carbonaceous feed material enters and is transferred through a screw-type feeder or lock hopper 144 under pressure into the lower end of the chamber. The carbonaceous feed material is transferred under pressure upwardly through the chamber 134 by means of a screw conveyor 146 extending the length thereof. The upper end of the screw conveyor is journaled by an end cap 148 bolted to the upper end of the chamber and at its lower end by means of a seal and bearing assembly 150 mounted on a flange bolted to the lower end of the chamber. The projecting end shaft of the screw conveyor 146 is connected by means of a coupling 152 to a variable speed electric motor 154.

The upper end of the chamber 134 is provided with a flanged outlet 156 adapted to be equipped with a rupture disk or other suitable pressure relief valve for releasing pressure from the reactor system at a preset excessive pressure level. The lower portion of the inclined chamber is provided with a second flanged outlet 158 connected by means of a suitable foraminous screen such as a Johnson-type screen in the wall of the chamber 134 through which the noncondensible gases are exhausted from the system. The flanged outlet 158 is connected in an arrangement as illustrated in FIG. 4 to a valve 120 to a product gas treatment and recovery system.

A preheating and partial dewartering of the carbonaceous material conveyed upwardly through the inclined chamber 134 is effected in response to the countercurrent flow of reaction gases discharged outwardly of the multiple hearth reactor 140 through the flanged inlet 138. As in the case of the embodiment described in connection with FIG. 1, a preheating of the feed material is achieved in part by the condensation of condensible portions of the reaction gas such as steam on the surfaces of the cool incoming feed material as well as by direct heat exchange. A preheating of the feed material is generally effected to a temperature of from about 200° up to about 500° F. The condensed liquids and the chemically combined water liberated during the preheating and compaction of the carbonaceous material in the chamber 134 drains downwardly and is extracted from the lower portion of the chamber through a port 160 in a manner as previously described in connection with FIG. 4 equipped with a suitable valve 124 for waste water treatment and recovery. The wall of the chamber 134 adjacent to the port 160 is provided with a suitable foraminous screen such as a Johnson-type screen to minimize escape of the solid portion of the feed material.

The multiple hearth reactor apparatus 140 as shown in FIG. 5 is of a structure similar to the reactor illustrated in FIG. 1 with the exception that the interior of the reactor defines a reaction zone and does not employ the angularly inclined hearths 64 as shown in FIG. 1 in the upper preheat section thereof. The reactor 140 is a similar construction and includes a dome-shaped upper portion 162 which is connected to a circular cylindrical center section 164 in gas-tight sealing relationship by means of annular flanges 166. An annular boss 168 is formed on the inner central portion of the dome-shaped portion 162 for receiving a bearing 170 in which the upper end of a rotary shaft 172 is journaled carrying a plurality of rabble arms 174 in accordance with the arrangement previously described in connection with FIG. 1. Each rabble arm is provided with a plurality of angularly disposed rabble teeth 176 for radially transferring the feed material radially inwardly and outwardly across a plurality of vertically spaced hearths 178.

In accordance with the foregoing arrangement, the preheated and partially dewatered feed material discharged from the upper end of the angularly inclined chamber 134 enters the reactor through the flanged inlet 138 equipped with a chute 180 for distributing the feed material across the uppermost hearth 178. In response to rotation of the rabble arms, the feed material passes downwardly in a cascading alternating manner as previously described and as indicated in the arrows of FIG. 5. Since the lower portion of the reactor 140 is substantially identical to that as shown in FIG. 1, no specific illustration is provided. The drive arrangement and supporting arrangement as illustrated in FIG. 1 can be satisfactorily employed for supporting the reactor 140.

As in the case of the arrangement of FIG. 1, the reactor 140 of FIG. 5 is provided with a cylindrical liner 182 defining the interior wall of the reaction zone which is provided with an exterior layer of insulation 184 between the wall 164. Similarly, the outer surface of the wall and dome-shaped upper portion can be provided with an insulating layer 186 to minimize heat loss.

In the embodiment illustrated in FIG. 5, the feed material on the upper surface of each of the hearths 178 is heated by an electrical heating device schematically indicated at 188 which is substantially completely enclosed within an annular conducting shield 190 affixed to the underside of the hearth. The shield 190 prevents deposition of tars and other thermal degradation products on the heating elements which would otherwise reduce the efficiency of heat transfer. The use of such shields 190 is equally applicable in connection with the embodiment illustrated in FIG. 1 for enclosing the tubes 94 and 96 to correspondingly prevent deposition of carbon and other extraneous matter thereon.

In accordance with the arrangement of FIG. 5, at least the lower surfaces of the annular shields 190 are cleaned by means of suitable scraping elements, preferably wire brushes indicated at 192 affixed to and extending radially along the upper edge of the rabble arms 174. Accordingly, rotation of the shaft 172 and the rabble arms thereon effects a continuous cleaning of the underside of the shields maintaining efficient heat transfer from the heating elements encased therein.

It is further contemplated that after prolonged operation, an undesirable accumulation of tars and other matter may occur on the interior surfaces of the reactors illustrated in FIGS. 1 and 5. In such event, the interior of the reactor can be cleaned by halting the further introduction of feed material and after the last product passes through the outlet thereof, air can be introduced into the interior of the reactor effecting oxidation and removal of the accumulated carbonaceous deposits.

In accordance with the arrangement illustrated in FIG. 5, the reactor 140 is also preferably provided with a flanged outlet 194 in the dome-shaped upper section thereof which is adapted to be connected to a suitable rupture disk or pressure relief system in a manner similar to the outlet 156 on the chamber 134.

The operating conditions for the reactor arrangement illustrated in FIG. 5 are substantially similar to those as previously described in connection with the reactor of FIG. 1 to produce an upgraded, chemically restructured partially pyrolyzed product.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A multiple hearth apparatus for thermal treatment of organic carbonaceous materials under pressure comprising a pressure vessel defining a chamber containing a plurality of superimposed annular hearths including a series of upper hearths angularly inclined downwardly toward the periphery of said chamber and a series of lower hearths spaced therebelow, inlet means in the upper portion of said vessel for introducing a moist carbonaceous feed material under pressure onto the uppermost hearth, rabble means disposed above each hearth for transferring the feed material radially along each hearth in an alternating inward and outward direction to effect a downward cascading of the feed material from one hearth to the next hearth therebelow, outlet means in the upper portion of said vessel for withdrwing volatile gases under pressure from said chamber, baffle means overlying the upper hearths and rabble means for directing the upward countercurrent flow of volatile gases adjacent to the feed material and in heat transfer relationship therewith, drain means disposed in communication with said upper hearths for withdrawing any liquid thereon under pressure from said chamber, heating means in said chamber disposed in the region of each of the lower hearths for independently heating the feed material thereon to a controlled elevated temperature for a period of time sufficient to vaporize at least a portion of the volatile substances therein to form volatile gases and a thermally restructured product and discharge means in the lower portion of said vessel for withdrawing the thermally restructured product under pressure from said chamber.

2. The apparatus as defined in claim 1 further including cleaning means associated with said rabble means for cleaning said drain means.

3. The apparatus as defined in claim 1 in which said heating means are disposed circumferentially around the interior of said chamber.

4. The apparatus as defined in claim 1 in which said heating means are disposed transversely at spaced intervals within the interior of said chamber and adjacent to the underside of each of said lower hearths.

5. The apparatus as defined in claim 1 in which said heating means are disposed within a protective conductive shield and further including scraping means on said rabble means for dislodging deposits from at least a portion of the exterior surfaces of said shield.

6. The apparatus as defined in claim 1 further including means for adjustably supporting said rabble means for vertical movement relative to the upper surfaces of said upper and said lower hearths.

7. An apparatus for thermal treatment of organic carbonaceous materials under pressure comprising a preheating chamber having an inlet at one end thereof for receiving the feed material under pressure and an outlet at the other end thereof for discharging the preheated feed material, conveying means for conveying the feed material through said chamber from said inlet to said outlet, drain means in said chamber for withdrawing any liquid therein under pressure from said chamber, outlet means in the upper portion of said chamber for withdrawing volatile gases under pressure from said chamber at a position spaced from said outlet, a multiple hearth apparatus comprising a pressure vessel containing a plurality of superimposed annular hearths, inlet means in the upper portion of said vessel disposed in communication with said outlet of said chamber for introducing the preheated feed material under pressure onto the uppermost hearth, rabble means disposed above each hearth for transferring the material radially along each hearth in an alternating inward and outward direction to effect a downward cascading of the feed material from one hearth to the next hearth therebelow, heating means in said vessel disposed in the region of each of said hearths for independently and for progressively heating the feed material on said hearths to a controlled elevated temperature for a period of time sufficient to vaporize at least a portion of the volatile substances therein to form volatile gases and a thermally restructured product, means for directing the volatile gases upwardly through said vessel and through said preheating chamber in a direction countercurrent to the travel of the feed material toward said outlet means, and discharge means in the lower portion of said vessel for discharging the thermally restructured product under pressure from said apparatus.

8. The apparatus as defined in claim 7 in which said conveying means in said chamber comprises a screw-type conveyor.

9. The apparatus as defined in claim 7 in which said heating means are disposed circumferentially around the periphery of the interior of said vessel.

10. The apparatus as defined in claim 7 in which said heating means are disposed transversely at spaced intervals within the interior of said vessel and adjacent to the underside of each of said hearths.

11. The apparatus as defined in claim 10 in which said heating means are disposed within a protective conductive shield and further including scraping means on said rabble means for dislodging deposits from at least a portion of the exterior surfaces of said shield.

12. The apparatus as defined in claim 7 further including means for adjustably supporting said rabble means in said vessel for vertical movement relative to the upper surfaces of said hearths.

13. A process for the thermal treatment of moist organic .carbonaceous materials under pressure which comprises the steps of:

(a) introducing a supply of moist carbonaceous material to be processed under pressure into a multiple hearth apparatus comprising a pressure vessel containing a plurality of superimposed annular hearths including a series of upper hearths angularly inclined downwardly toward the periphery of the vessel and a series of lower hearths spaced therebelow, (b) depositing the feed material onto the uppermost hearth and transferring the feed material radially along each hearth in an alternating inward and outward direction to effect a downward cascading of the feed material from one hearth to the next hearth therebelow, (c) contacting the feed material with a countercurrent flow of volatile gases to effect a preheating of the feed material on the upper hearths to a temperature of from about 200° up to about 500° F., (d) draining liquid from the upper hearths derived from the moisture liberated in the feed material and condensible liquids in the volatile gases under pressure from the interior of said vessel, (e) independently heating the preheated feed material on each of the lower hearths to a controlled elevated temperature for a period of time sufficient to vaporize at least a portion of the volatile substances therein to form volatile gases and a solid thermally restructured product, (f) withdrawing the residual volatile gases from the upper portion of said vessel and discharging the solid product under pressure from the lower portion of said vessel.

14. A process for the thermal treatment of moist organic carbonaceous materials under pressure which comprises the steps of:

(a) introducing a supply of moist carbonaceous feed material to be processed under pressure into a preheating chamber and preheating the feed material to a temperature of from about 200° to about 500° by countercurrent heat transfer contact with reaction gases, (b) extracting any liquid formed in the preheating chamber from said chamber under pressure, (c) introducing the preheated feed material under pressure into a multiple hearth apparatus comprising a pressure vessel containing a plurality of superimposed annular hearths, (d) distributing the preheated feed material on the uppermost hearth and transferring the feed material radially along each hearth in an alternating inward and outward direction to effect a downward cascading of the feed material from one hearth to the next hearth therebelow, (e) independently heating the feed material in said vessel to a controlled elevated temperature for a period of time sufficient to vaporize at least a portion of the volatile substances therein to form volatile gases and a solid thermally restructured product, (f) transferring the volatile gases in a countercurrent direction to the feed material through the pressure vessel and into said preheating chamber, and (g) discharging the solid product under pressure from said vessel.

* * * * *